US006449372B1

(12) United States Patent
Greminger

(10) Patent No.: US 6,449,372 B1
(45) Date of Patent: Sep. 10, 2002

(54) METHOD FOR MATCHING HEARING AIDS BINAURALLY

(75) Inventor: Michael Greminger, Zürich (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/472,472

(22) Filed: Dec. 27, 1999

(30) Foreign Application Priority Data

Jan. 5, 1999 (EP) ..... 99100056

(51) Int. Cl.[7] ..... H04R 25/00
(52) U.S. Cl. ..... 381/314; 381/323
(58) Field of Search ..... 381/314, 312, 381/321, 315, 320, 60, 58, 59

(56) References Cited

U.S. PATENT DOCUMENTS 5,144,674 A * 9/1992 Meyer et al.
5,479,522 A * 12/1995 Lindemann et al.
5,835,611 A * 11/1998 Kaiser et al.
5,991,419 A * 11/1999 Brander
6,167,138 A * 12/2000 Shennib

FOREIGN PATENT DOCUMENTS

| | | | |
|---|---|---|---|
| DE | 4418203 | * | 7/1995 |
| EP | 128 848 | | 5/1984 |
| EP | 537 026 A2 | | 4/1993 |
| EP | 578 019 A2 | | 6/1993 |
| WO | 97/23117 | | 6/1997 |

* cited by examiner

*Primary Examiner*—Sinh Tran
(74) *Attorney, Agent, or Firm*—Pearne & Gordon LLP

(57) ABSTRACT

The invention relates to a method for matching binaurally the transmission characteristics of a consisting of hearing-aid portions (4,5) one for the left and the other for the right ear, using a data processing apparatus (1) connectable to a pointer device (3) and a display unit (2), the pointer device (3) being used to change parameters of the transmission characteristics. The method of the invention is characterized in the the parameters of one of the hearing-aid portions (4, 5) can be adjusted just as well independently of the parameters of the other hearing-aid portion (5, 4) as in that the parameters of both hearing-aid portions (4,5) can be adjusted simultaneously.

16 Claims, 2 Drawing Sheets

METHOD FOR MATCHING HEARING AIDS BINAURALLY

The present invention relates to a method defined in the preamble of claim 1.

Hearing aids must be matched to specific requirements, that is to the particular hearing impairment of a patient. As a rule a patient audiogram must be recorded on the basis of which first an optimal hearing aid shall be selected to best meet the hearing impairment being addressed. Moreover, once a hearing aid has been selected, the adjustable parameters must be optimally set on the basis of said audiogram.

The German Offenlegungsschrift 44 18 203 discusses one approach in matching hearing aids. This known disclosure relates to matching the transmission characteristics of a hearing aid using a data processing device connectable to the hearing aid, the adjustable parameters being set using a pointer device and a display unit showing both the instantaneous values as well as the transfer characteristic resulting from them.

However the known procedure incurs the drawback of precluding overview, and hence being totally unsuitable, for binaural matching: binaural matching requires accurately matching to each other two hearing-aid portions, one for the left ear and one for the right ear. This procedure requires taking into account the interactions of parameter settings between the two hearing-aid portions.

It is the objective of the present invention to create an appropriate method to optimally match binaural hearing aids.

This problem is solved by the features of the invention stated in claim 1. Advantageous embodiments of the invention are stated in further claims.

The invention offers the following advantages: because the parameters determining the transmission characteristics of the hearing-aid portions can be adjusted simultaneously as well as for each of the two sides independently of the other, extremely accurate and surveyable adjustment is now possible. In particular the possibility of simultaneous adjustment allows adjusting the hearing-aid portions faster and more efficiently than do the known procedures.

The invention is elucidated in illustrative manner below in relation to the drawings.

FIG. 1 is a functional block diagram of apparatus implementing the method of the invention, and FIG. 2 shows one way to display and change the transmission characteristics of hearing-aid parameters to be determined, and FIG. 3 is a detailed view of a scroll bar to adjust the hearing-aid parameters.

FIG. 1 shows data-processing apparatus 1 which may be hooked up to a display unit 2, a pointer device 3 and a hearing aid consisting of hearing-aid portions 4 and 5. The dashed connection 6 merely indicates such a connection is present, in one embodiment of hearing aids, between the two hearing-aid portions 4 and 5. In this kind of hearing-aid per se the two sides (left and right hearing-aid portions) may interact with each other, whereas the method of the invention can be successfully used regardless of the kind of hearing aid. Therefore this connection 6 is of subordinate significance in binaural hearing-aid matching.

The hearing aid 4, 5 is connected to the data processing apparatus 1 solely to match the variable parameters. As soon as the pertinent parameters have been determined, in a manner elucidated below, they are transmitted to the hearing aid 4, 5. After said transmission, the hearing aid 4, 5 can be disconnected from said data processing apparatus 1 and be operated independently of it.

Both the data processing apparatus 1 and the pointer device 3 may be commercially available products. The data processing apparatus 1 may be a so-called PC and the pointer device 3 may be a computer mouse.

FIG. 2 shows a screen of the display unit 2 of FIG. 1 containing on one hand plots of the effective, particular transmission characteristics in windows 7 through 10 and on the other hand scroll bars 11 through 16 and adjustment buttons 17, the particular parameters being adjustable by means of the scroll bars 11 through 16 or scroll arrows 17. In a further embodiment of the invention, a patient's desired optimal transmission characteristics are superposed on the the particular, effective graphic windows 7 through 10. In this manner the operating personnel easily can visually check the results caused by changing the parameters.

As already mentioned initially, the parameters consisting of the transmission characteristics of the left and right sides are mutually independent when matching the hearing aids binaurally, but they also may be modified jointly.

FIG. 2 illustrates two approaches allowing to match parameters in simple and very user-friendly manner. The upper half of FIG. 2 shows the feasibility to set the gains for the left and right sides of the hearing aid 4, 5 individually by means of the scroll bars 11 and 12. For that purpose a cursor generated by the display unit 2 and controlled by the pointer device 3 (FIG. 1) is guided onto a scroll box of which the instantaneous position, relative to the two limit stops representing the maximum and minimum values of the particular parameter, corresponds to the instantaneous value of the particular parameter. By pushing a key on the pointer device 3 when its cursor is on said scroll box, this box, and hence the value of the particular parameter, in this case the gain, can be changed by shifting the scroll box position by dragging the pointer device 3.

A further way to change a parameter value using the pointer device 3 by means of the scroll bar 11 consists in guiding the cursor of the pointer device 3 over a switching surface 19 or 20 located at the particular ends of the scroll bar 11 and by stepwise increasing or decreasing the particular parameter value by actuating the key present on the pointer device 3.

Yet another way to change the parameter value using the pointer device 3 on the scroll bar 11 consists in guiding the cursor of the pointer device 3 over an area between the scroll box 18 and the switching surface 19 and the switching surface 20 to implement stepwise increases and decreases resp. of the particular parameter value, and in stepwise increasing and decreasing the particular parameter value by pushing the key on the pointer device 3.

To inform the hearing-aid technician and to allow him to check out the settings, the value set using the scroll bar 11 is numerically displayed below this bar. Furthermore the consequences of changing the gain on the transmission characteristics are continuously displayed in the graphics window 7.

Corresponding settings are similarly carried out for the gain of the second hearing-aid portion using the scroll bar 12, again the same ease of checking being provided here as well.

Frequently there will be a need to match simultaneously the corresponding parameters of the two hearing-aid portions 4, 5. The invention allows adjusting the parameters simultaneously using a single adjustment. For that purpose an adjusting button 17 comprising two switching areas is provided in the embodiment as shown in the upper pan of FIG. 2. By driving these switching areas in the manner described above, the particular parameters, in this case the binaural gain of the two hearing-aid portions 4 and 5 are changed simultaneously and in equal steps. By changing the binaural gain, both the scroll boxes in the scroll bars 11 and 12 and the graphics 7 and 8 representing the transmission characteristics shall be changed correspondingly.

In a further implementation of the method of the invention, when a maximum or a minimum value is reached in the procedure changing simultaneously the parameter values, the parameter value which does not correspond to the maximum or the minimum value will be set to that value at which the other parameter value is at the maximum or minimum value. This feature precludes one of the hearing-aid portions 4 or 5 being over-driven even if actually the maximum or minimum value has not yet been reached at the other hearing-aid portion 5 or 4. In other words, the differential of the two corresponding parameter values remains constant when these parameter values are being changed.

The lower half of FIG. 2 shows another approach in implementing the parameter changes of the invention. In this mode, several parameter values acting on different frequency ranges are simultaneously modifiable. This feature relates to the scroll bars 13, 14 and 15 which affect correspondingly the lower, middle and upper frequency range of hearing. A scroll bar 16 also is present to allow limiting the maximum output level.

As shown in FIG. 2, the scroll boxes of the scroll-bars 13 through 16 are split in two, again allowing separate adjustment of the two hearing-aid portions 4 and 5, the instantaneous transmission characteristics being shown in the graphics windows 9 and 10. The invention again provides switching surfaces which in this embodiment are situated directly against the displacement path of the split scroll boxes. In this embodiment however these switching surfaces only serve to change the parameters simultaneously. The particular relative position of one on of the scroll bars 13 through 16 therefore remains unchanged when these switching surfaces are actuated. In particular the mutual relative position of the scroll box segments remains unchanged, even when the minimum or maximum value is reached. Moreover the parameter values may be changed exactly as already described using the pointer device 3.

FIG. 3 shows one of the bar scrolls 13 through 16 of FIG. 2 on an enlarged scale, said bar consisting of two scroll box portions BL and BR and of the switching surfaces G and K to simultaneously change the parameter of the two hearing-aid portions 4 and 5. The absolute numerical values of the set, instantaneous parameter values are shown below the lower end of scroll bar in the numbers field MW.

Conceivably however and even preferably in many applications, relative values relating to a reference magnitude may be displayed in lieu of absolute ones, such relative values for instance resulting from the desired transmission characteristics.

What is claimed is:

1. A method to binaurally match transmission characteristics of a hearing-aid portion (4) for a left ear with transmission characteristics of a hearing-aid portion (5) for a right ear, said method using a data processing apparatus (1) connectable to a pointer device (3) and to a display unit (2), the pointer device (3) being used to change parameters of the transmission characteristics, wherein parameters of one of the hearing-aid portions (4, 5) can be adjusted independently of the parameters of the other hearing-aid portion (5, 4) and wherein the parameters of both hearing-aid portions (4, 5) can be adjusted simultaneously.

2. The method as claimed in claim 1, wherein, when mutually corresponding parameter values are adjusted, a differential of the corresponding parameter values remains constant.

3. The method as claimed in either of claims 1 and 2, wherein the parameters are adjustable by means of scroll bars (11 . . . 16) shown on the display unit (2), said scroll bars consisting of at least one scroll box (18, BL, BR) movable between switching surfaces (19, 20, G, K), an instantaneous distance between the scroll box (18, BL, BR) and the switching surfaces (19, 20, G, K) representing the differential between an instantaneous parameter value and a minimum or maximum value, a parameter of one hearing-aid portion (4, 5) being adjusted between the scroll box (18, BL, BR) and one of the switching surfaces (19, 20, G, K), by one of: dragging the corresponding scroll box (18, BL, BR) using the pointer device (3) and clicking.

4. The method as claimed in claim 3, wherein the scroll box (18) is split into two parts (BL, BR) of which one part (BL) is used to adjust a parameter of one of the hearing-aid portions (4, 5) and the other part (BR) is used to adjust the corresponding parameter of the other hearing-aid portion (5, 4), and in that simultaneous adjustment of the parameters of the two hearing-aid portions (4, 5) is implemented by means of the switching surfaces (G, K).

5. The method as claimed in claim 3, wherein one of the instantaneous absolute value or the instantaneous relative value computed in relation to a reference value of a scroll bar (11 . . . , 16) is numerically displayed in the region of the scroll bar (11 . . . , 16).

6. The method as claimed in claim 1, wherein particular effective transmission characteristics of the hearing-aid portions (4, 5) are graphically displayed in graph windows (7, . . . , 10).

7. The method as claimed in claim 6, wherein a desired transmission characteristic for at least one of the hearing-aid portions (4, 5) is displayed on the display unit (2), said desired characteristic preferably being displayed in the same graph window (7, . . . , 10) as the effective particular transmission characteristic.

8. The method as claimed in claim 1, wherein the adjusted parameters are transmitted from the data processing apparatus (1) to the hearing-aid portions (4, 5).

9. A method to binaurally match transmission characteristics of both a hearing-aid portion (4) for a left ear and a hearing-aid portion (5) for a right ear, to a patient audiogram, said method using a data processing apparatus (1) connectable to a pointer device (3) and to a display unit (2), the pointer device (3) being used to change parameters of the transmission characteristics, wherein parameters of one of the hearing-aid portions (4, 5) can be adjusted independently of the parameters of the other hearing-aid portion (5, 4) and wherein the parameters of both hearing-aid portions (4, 5) can be adjusted simultaneously.

10. The method as claimed in claim 9, wherein, when mutually corresponding parameter values are adjusted, a differential of the corresponding parameter values remains constant.

11. The method as claimed in either of claims 9 and 10, wherein the parameters are adjustable by means of scroll bars (11 . . . 16) shown on the display unit (2), said scroll bars consisting of at least one scroll box (18, BL, BR) movable between switching surfaces (19, 20, G, K), an instantaneous distance between the scroll box (18, BL, BR) and the switching surfaces (19, 20, G, K) representing the differential between an instantaneous parameter value and a minimum or maximum value, a parameter of one hearing-aid portion (4, 5) being adjusted between the scroll box (18, BL, BR) and one of the switching surfaces (19, 20, G, K), by one of: dragging the corresponding scroll box (18, BL, BR) using the pointer device (3) and clicking.

12. The method as claimed in claim 11, wherein the scroll box (18) is split into two parts (BL, BR) of which one part (BL) is used to adjust a parameter of one of the hearing-aid portions (4, 5) and the other part (BR) is used to adjust the corresponding parameter of the other hearing-aid portion (5, 4), and in that simultaneous adjustment of the parameters of the two hearing-aid portions (4, 5) is implemented by means of the switching surfaces (G, K).

13. The method as claimed in claim 11, wherein one of the instantaneous absolute value or the instantaneous relative value computed in relation to a reference value of a scroll bar (11, . . . , 16) is numerically displayed in the region of the scroll bar (11, . . . , 16).

14. The method as claimed in claim 9, wherein particular effective transmission characteristics of the hearing-aid portions (4, 5) are graphically displayed in graph windows (7, . . . , 10).

15. The method as claimed in claim 14, wherein a desired transmission characteristic for at least one of the hearing-aid portions (4, 5) is displayed on the display unit (2), said desired characteristic preferably being displayed in the same graph window (7, . . . , 10) as the effective particular transmission characteristic.

16. The method as claimed in claim 9, wherein the adjusted parameters are transmitted from the data processing apparatus (1) to the hearing-aid portions (4, 5).

* * * * *

UNITED STATES PATENT AND TRADEMARK OFFICE

CERTIFICATE OF CORRECTION

PATENT NO. : 6,449,372 B1
DATED : September 10, 2002
INVENTOR(S) : Greminger

It is certified that error appears in the above-identified patent and that said Letters Patent is hereby corrected as shown below:

See ABSTRACT
See Specification

(12) United States Patent
Greminger

(10) Patent No.: US 6,449,372 B1
(45) Date of Patent: Sep. 10, 2002

(54) METHOD FOR MATCHING HEARING AIDS BINAURALLY

(75) Inventor: Michael Greminger, Zürich (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/472,472

(22) Filed: Dec. 27, 1999

(30) Foreign Application Priority Data

Jan. 5, 1999 (EP) ..... 99100056

(51) Int. Cl.[7] ..... H04R 25/00
(52) U.S. Cl. ..... 381/314; 381/323
(58) Field of Search ..... 381/314, 312, 381/321, 315, 320, 60, 58, 59

(56) References Cited

U.S. PATENT DOCUMENTS 5,144,674 A * 9/1992 Meyer et al.
5,479,522 A * 12/1995 Lindemann et al.
5,835,611 A * 11/1998 Kaiser et al.
5,991,419 A * 11/1999 Brander
6,167,138 A * 12/2000 Shennib

FOREIGN PATENT DOCUMENTS

| | | | |
|---|---|---|---|
| DE | 4418203 | * | 7/1995 |
| EP | 128 848 | | 5/1984 |
| EP | 537 026 A2 | | 4/1993 |
| EP | 578 019 A2 | | 6/1993 |
| WO | 97/23117 | | 6/1997 |

* cited by examiner

*Primary Examiner*—Sinh Tran
(74) *Attorney, Agent, or Firm*—Pearne & Gordon LLP

(57) ABSTRACT

A method for matching binaurally the transmission characteristics of hearing-aid portions (4, 5) one portion being for the left ear and the other for the right ear. The method uses a data processing apparatus (1) connected to a pointer device (3) and a display unit (2). The pointer device (3) is used to change parameters of the transmission characteristics. The parameters of one of the hearing-aid portions (4, 5) can be adjusted independently of, or simultaneously with, adjustment of the parameters of the other hearing-aid portion (5, 4).

16 Claims, 2 Drawing Sheets

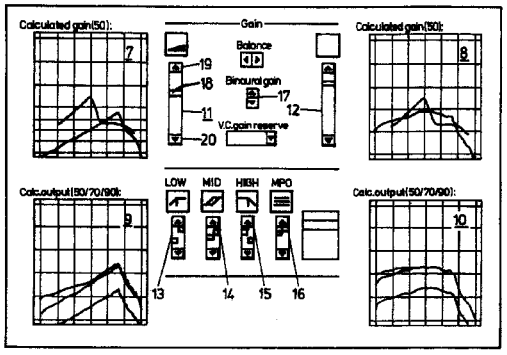

Signed and Sealed this

Seventeenth Day of February, 2004

JON W. DUDAS
*Acting Director of the United States Patent and Trademark Office*

(12) United States Patent
Greminger

(10) Patent No.: US 6,449,372 B1
(45) Date of Patent: Sep. 10, 2002

(54) METHOD FOR MATCHING HEARING AIDS BINAURALLY

(75) Inventor: Michael Greminger, Zürich (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/472,472

(22) Filed: Dec. 27, 1999

(30) Foreign Application Priority Data

Jan. 5, 1999 (EP) ..... 99100056

(51) Int. Cl.[7] ..... H04R 25/00
(52) U.S. Cl. ..... 381/314; 381/323
(58) Field of Search ..... 381/314, 312, 381/321, 315, 320, 60, 58, 59

(56) References Cited

U.S. PATENT DOCUMENTS 5,144,674 A * 9/1992 Meyer et al.
5,479,522 A * 12/1995 Lindemann et al.
5,835,611 A * 11/1998 Kaiser et al.
5,991,419 A * 11/1999 Brander
6,167,138 A * 12/2000 Shennib

FOREIGN PATENT DOCUMENTS

| | | | |
|---|---|---|---|
| DE | 4418203 | * | 7/1995 |
| EP | 128 848 | | 5/1984 |
| EP | 537 026 A2 | | 4/1993 |
| EP | 578 019 A2 | | 6/1993 |
| WO | 97/23117 | | 6/1997 |

* cited by examiner

*Primary Examiner*—Sinh Tran
(74) *Attorney, Agent, or Firm*—Pearne & Gordon LLP

(57) ABSTRACT

A method for matching binaurally the transmission characteristics of hearing-aid portions (4, 5) one portion being for the left ear and the other for the right ear. The method uses a data processing apparatus (1) connected to a pointer device (3) and a display unit (2). The pointer device (3) is used to change parameters of the transmission characteristics. The parameters of one of the hearing-aid portions (4, 5) can be adjusted independently of, or simultaneously with, adjustment of the parameters of the other hearing-aid portion (5, 4).

16 Claims, 2 Drawing Sheets

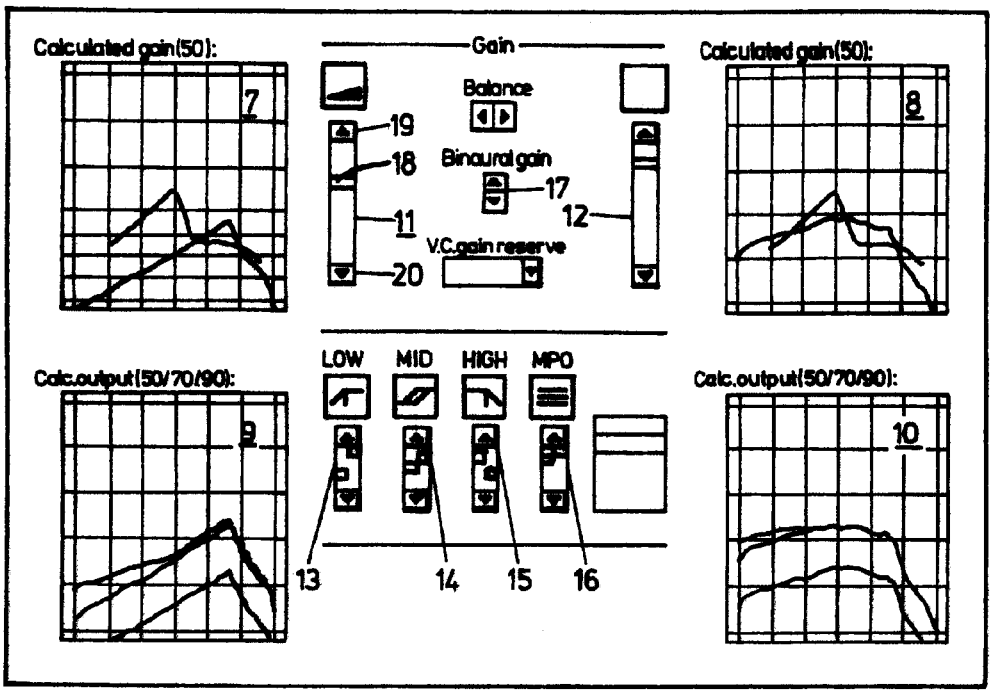

METHOD FOR MATCHING HEARING AIDS BINAURALLY

BACKGROUND OF THE INVENTION

Hearing aids must be matched to specific requirements, that is to the particular hearing impairment of a patient. As a rule, a patient audiogram must be recorded on the basis of which an optimal hearing aid is selected to best meet the hearing impairment being addressed. Moreover, once a hearing aid has been selected, the adjustable parameters must be optimally set on the basis of said audiogram.

The German *Offenlegungsschrift* 44 18 203 discusses one approach in matching hearing aids. This disclosure relates to matching the transmission characteristics of a hearing aid using a data processing device connectable to the hearing aid. The adjustable parameters are set using a pointer device and a display unit showing both the instantaneous values as well as the transfer characteristic resulting from them.

However the known procedure incurs the drawback of precluding overview, and hence being totally unsuitable, for binaural matching. Binaural matching requires accurately matching to each other two hearing-aid portions, one for the left ear and one for the right ear. This procedure requires taking into account the interactions of parameter settings between the two hearing-aid portions.

SUMMARY OF THE INVENTION

It is an objective of the present invention to create an appropriate method to optimally match binaural hearing aids.

The invention offers several advantages. For instance, because the parameters determining the transmission characteristics of the hearing-aid portions can be adjusted simultaneously as well as for each of the two sides independently of the other, extremely accurate and surveyable adjustment is now possible. In particular, the possibility of simultaneous adjustment allows adjusting the hearing-aid portions faster and more efficiently than do the known procedures.

BRIEF DESCRIPTION OF THE DRAWINGS

The invention is elucidated in illustrative manner below in relation to the drawings.

DETAILED DESCRIPTION OF THE PREFERRED EMBODIMENTS

Figure 1:
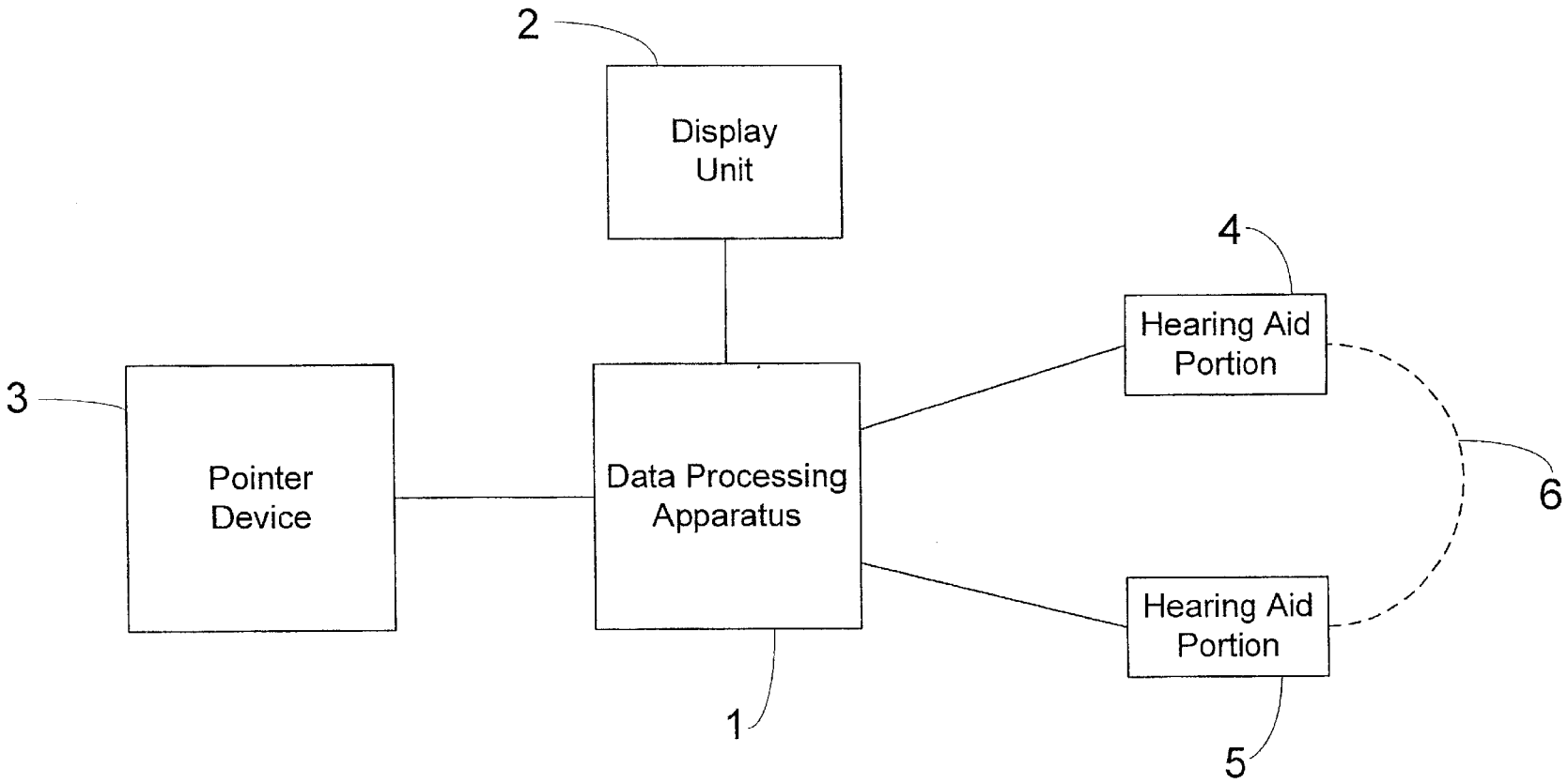
FIG. 1 is a functional block diagram of apparatus implementing the method of the invention.

FIG. 1 shows data-processing apparatus 1, which may be hooked up to a display unit 2, a pointer device 3, and a hearing aid consisting of hearing-aid portions 4 and 5. The dashed connection 6 merely indicates such a connection is present, in one embodiment of hearing aids, between the two hearing-aid portions 4 and 5. In this kind of hearing-aid per se the two sides (left and right hearing-aid portions) may interact with each other, whereas the method of the invention can be successfully used regardless of the kind of hearing aid. Therefore, this connection 6 is of subordinate significance in binaural hearing-aid matching.

The hearing aid 4, 5 is connected to the data processing apparatus 1 solely to match the variable parameters. As soon as the pertinent parameters have been determined, in a manner elucidated below, they are transmitted to the hearing aid 4, 5. After the transmission, the hearing aid 4, 5 can be disconnected from the data processing apparatus 1 and be operated independently of it.

Both the data processing apparatus 1 and the pointer device 3 may be commercially available products. The data processing apparatus 1 may be a so-called PC and the pointer device 3 may be a computer mouse.

Figure 2:
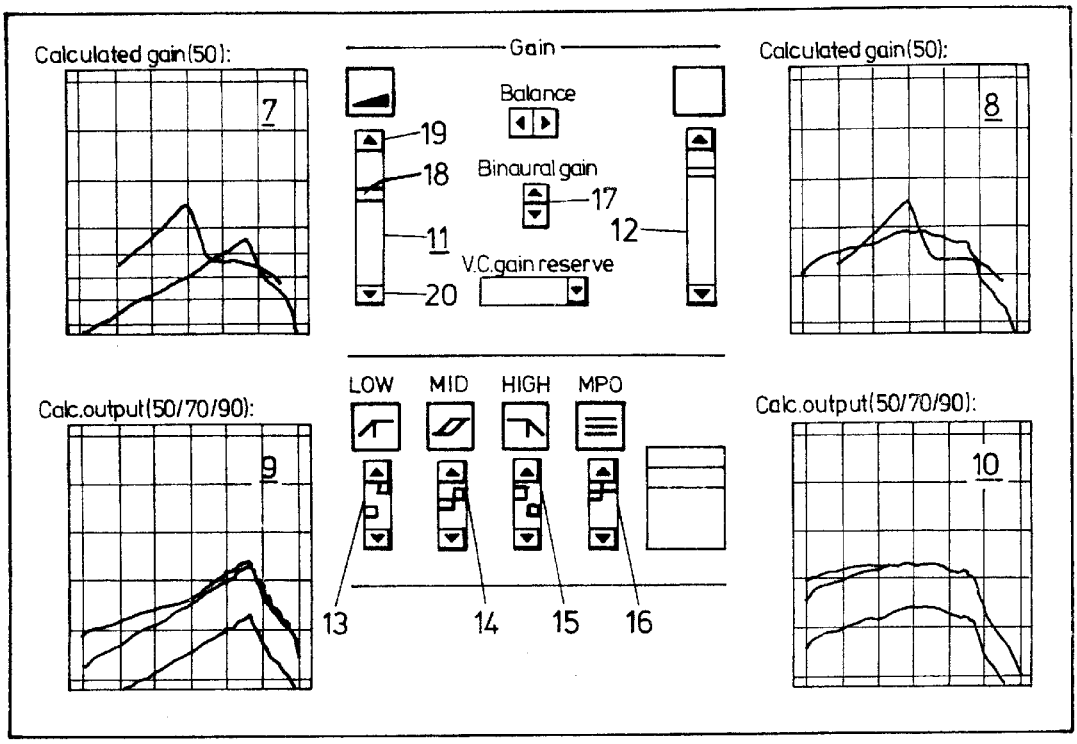
FIG. 2 shows one way to display and change the transmission characteristics of hearing-aid parameters to be determined.

FIG. 2 shows a screen of the display unit 2 of FIG. 1 containing, on the one hand, plots of the effective, particular transmission characteristics in windows 7 through 10 and, on the other hand, scroll bars 11 through 16 and adjustment buttons 17. The particular parameters are adjustable by means of the scroll bars 11 through 16 and scroll arrows 17. In a further embodiment of the invention, a patient's desired optimal transmission characteristics are superposed on the the particular, effective graphic windows 7 through 10. In this manner the operating personnel easily can visually check the results caused by changing the parameters.

As already mentioned initially, the parameters consisting of the transmission characteristics of the left and right sides are mutually independent when matching the hearing aids binaurally, but they also may be modified jointly.

FIG. 2 illustrates two approaches to match parameters in simple and very user-friendly manner. The upper half of FIG. 2 shows the feasibility to set the gains for the left and right sides of the hearing aid 4, 5 individually by means of the scroll bars 11 and 12. For that purpose, a cursor generated by the display unit 2 and controlled by the pointer device 3 (FIG. 1) is guided onto a scroll box. The instantaneous position of the cursor relative to the two limit stops representing the maximum and minimum values of the particular parameter, corresponds to the instantaneous value of the particular parameter. By pushing a key on the pointer device 3 when the pointer device cursor is on the scroll box, this box, and hence the value of the particular parameter, in this case the gain, can be changed by shifting the scroll box position by dragging the pointer device 3.

A further way to change a parameter value using the pointer device 3 by means of the scroll bar 11 consists in guiding the cursor of the pointer device 3 over a switching surface 19 or 20 located at the particular ends of the scroll bar 11, and by stepwise increasing or decreasing the particular parameter value by actuating the key present on the pointer device 3.

Yet another way to change the parameter value using the pointer device 3 on the scroll bar 11 consists in guiding the cursor of the pointer device 3 over an area between the scroll box 18 and the switching surface 19 and the switching surface 20 to implement stepwise increases and decreases, respectively, of the particular parameter value, and in stepwise increasing and decreasing the particular parameter value by pushing the key on the pointer device 3.

To inform the hearing-aid technician and to allow him to check out the settings, the value set using the scroll bar 11 is numerically displayed below the bar. Furthermore, the consequences of changing the gain on the transmission characteristics are continuously displayed in the graphics window 7.

Corresponding settings are similarly carried out for the gain of the second hearing-aid portion using the scroll bar 12, again the same ease of checking being provided here as well.

Frequently there will be a need to match simultaneously the corresponding parameters of the two hearing-aid portions 4, 5. The invention allows adjusting the parameters simultaneously using a single adjustment. For that purpose, an adjusting button 17 comprising two switching areas is provided in the preferred embodiment as shown in the upper part of FIG. 2. By driving these switching areas in the manner described above, the particular parameters, in this case the binaural gain of the two hearing-aid portions 4 and 5, are changed simultaneously and in equal steps. By changing the binaural gain, both the scroll boxes in the scroll bars 11 and 12 and the graphics 7 and 8 representing the transmission characteristics shall be changed correspondingly.

In a further implementation of the method of the invention, when a maximum or a minimum value is reached in the procedure changing simultaneously, the parameter values, the parameter value which does not correspond to the maximum or the minimum value will be set to that value at which the other parameter value is at the maximum or minimum value. This feature precludes one of the hearing-aid portions 4 or 5 from being over-driven even if actually the maximum or minimum value has not yet been reached at the other hearing-aid portion 5 or 4. In other words, the differential of the two corresponding parameter values remains constant when these parameter values are being changed.

The lower half of FIG. 2 shows another approach in implementing the parameter changes of the invention. In this mode, several parameter values acting on different frequency ranges are simultaneously modifiable. This feature relates to the scroll bars 13, 14 and 15 which, respectively, affect the lower, middle and upper frequency range of hearing. A scroll bar 16 also is present to allow limiting the maximum output level.

As shown in FIG. 2, the scroll boxes of the scroll-bars 13 through 16 are split in two, again allowing separate adjustment of the two hearing-aid portions 4 and 5. The instantaneous transmission characteristics are shown in the graphics windows 9 and 10. The invention again provides switching surfaces, which in this embodiment are situated directly against the displacement path of the split scroll boxes. In this embodiment, however, these switching surfaces only serve to change the parameters simultaneously. The particular relative position of one on of the scroll bars 13 through 16, therefore, remains unchanged when these switching surfaces are actuated. In particular, the mutual relative position of the scroll box segments remains unchanged, even when the minimum or maximum value is reached. Moreover, the parameter values may be changed exactly as already described using the pointer device 3.

Figure 3:
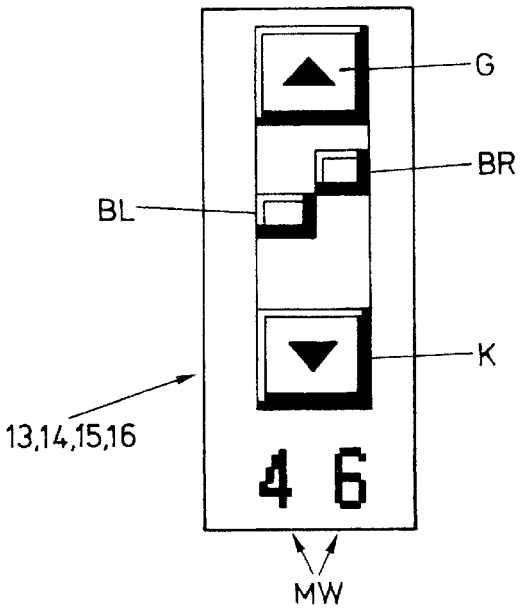
FIG. 3 is a detailed view of a scroll bar to adjust the hearing-aid parameters.
Figure 1:
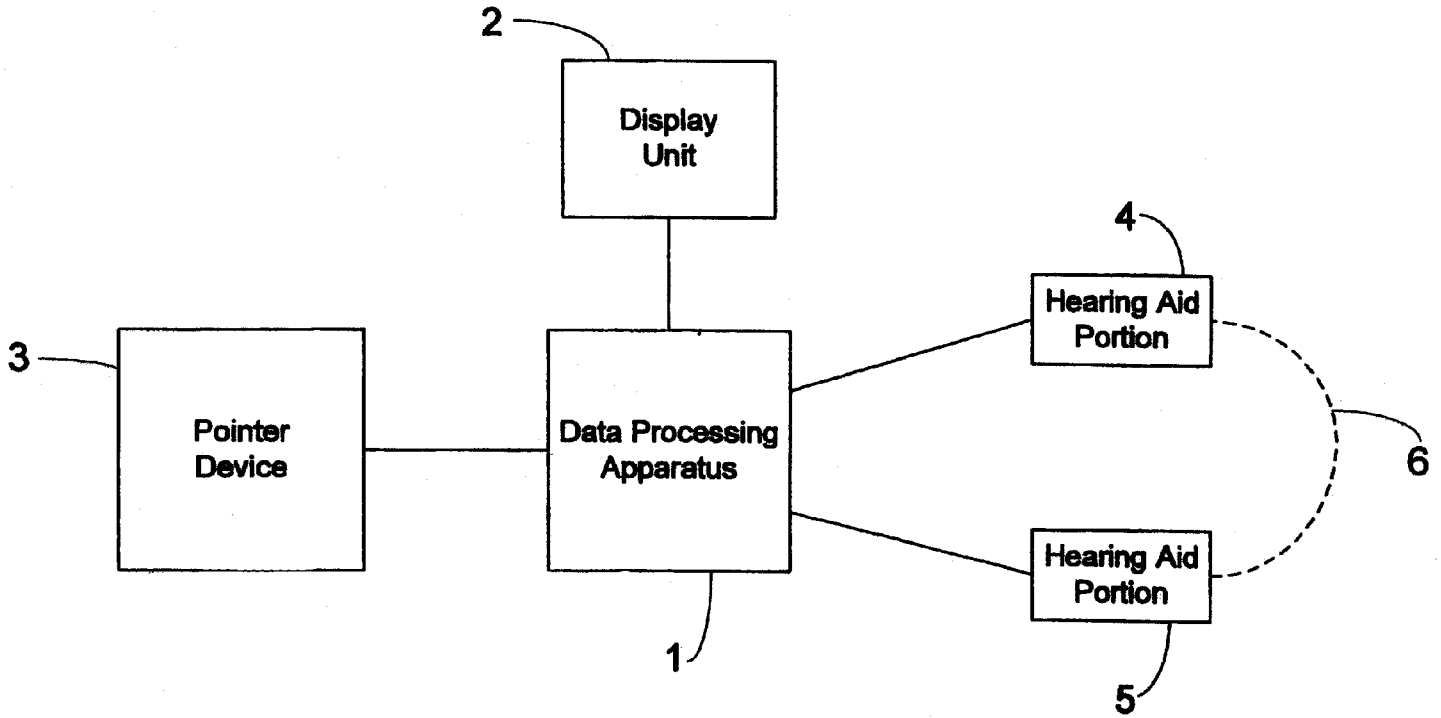
Figure 2:
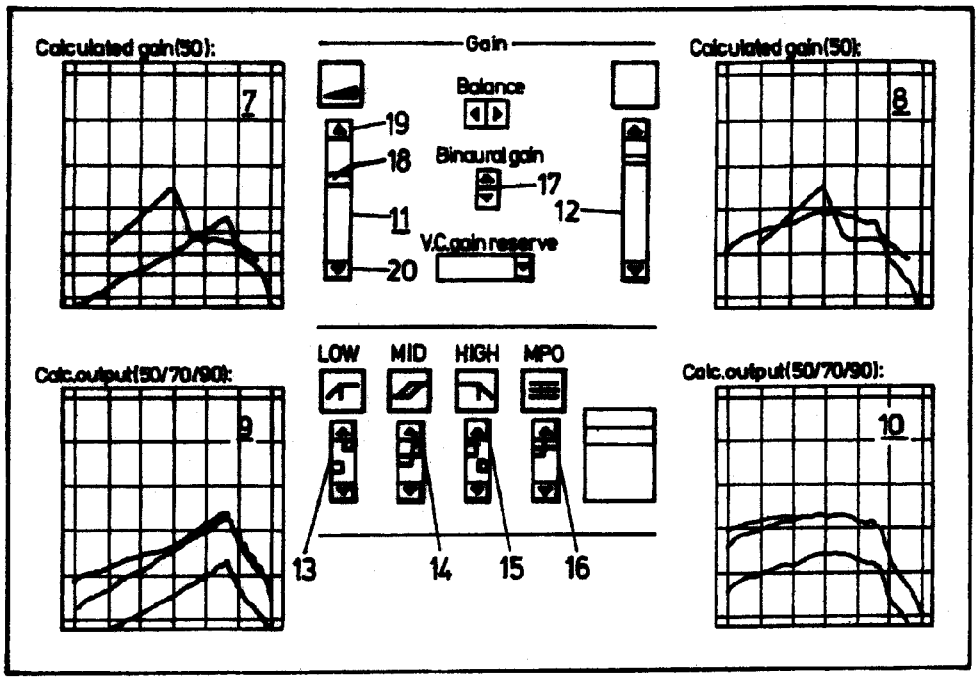
Figure 3:
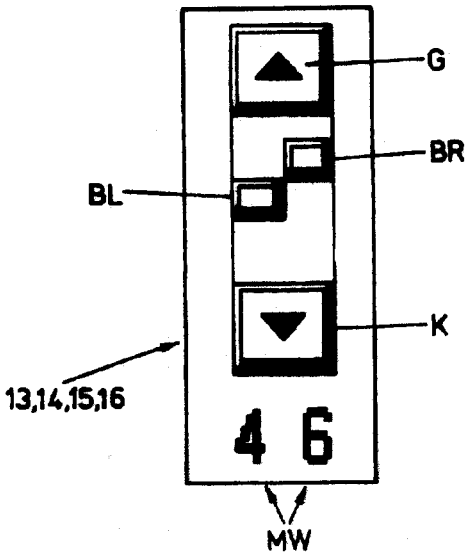

FIG. 3 shows an enlarged view of one of the bar scrolls 13 through 16 of FIG. 2. The scroll bar has two scroll box portions BL and BR and switching surfaces G and K to simultaneously change the parameter of the two hearing-aid portions 4 and 5. The absolute numerical values of the set, instantaneous parameter values are shown below the lower end of scroll bar in the numbers field MW. Conceivably however and even preferably in many applications, relative values relating to a reference magnitude may be displayed in lieu of absolute ones, such relative values for instance resulting from the desired transmission characteristics.

What is claimed is:

1. A method to binaurally match transmission characteristics of a hearing-aid portion (4) for a left ear with transmission characteristics of a hearing-aid portion (5) for a right ear, said method using a data processing apparatus (1) connectable to a pointer device (3) and to a display unit (2), the pointer device (3) being used to change parameters of the transmission characteristics, wherein parameters of one of the hearing-aid portions (4, 5) can be adjusted independently of the parameters of the other hearing-aid portion (5, 4) and wherein the parameters of both hearing-aid portions (4, 5) can be adjusted simultaneously.

2. The method as claimed in claim 1, wherein, when mutually corresponding parameter values are adjusted, a differential of the corresponding parameter values remains constant.

3. The method as claimed in either of claims 1 and 2, wherein the parameters are adjustable by means of scroll bars (11 . . . 16) shown on the display unit (2), said scroll bars consisting of at least one scroll box (18, BL, BR) movable between switching surfaces (19, 20, G, K), an instantaneous distance between the scroll box (18, BL, BR) and the switching surfaces (19, 20, G, K) representing the differential between an instantaneous parameter value and a minimum or maximum value, a parameter of one hearing-aid portion (4, 5) being adjusted between the scroll box (18, BL, BR) and one of the switching surfaces (19, 20, G, K), by one of: dragging the corresponding scroll box (18, BL, BR) using the pointer device (3) and clicking.

4. The method as claimed in claim 3, wherein the scroll box (18) is split into two parts (BL, BR) of which one part (BL) is used to adjust a parameter of one of the hearing-aid portions (4, 5) and the other part (BR) is used to adjust the corresponding parameter of the other hearing-aid portion (5, 4), and in that simultaneous adjustment of the parameters of the two hearing-aid portions (4, 5) is implemented by means of the switching surfaces (G, K).

5. The method as claimed in claim 3, wherein one of the instantaneous absolute value or the instantaneous relative value computed in relation to a reference value of a scroll bar (11 . . . , 16) is numerically displayed in the region of the scroll bar (11 . . . , 16).

6. The method as claimed in claim 1, wherein particular effective transmission characteristics of the hearing-aid portions (4, 5) are graphically displayed in graph windows (7, . . . , 10).

7. The method as claimed in claim 6, wherein a desired transmission characteristic for at least one of the hearing-aid portions (4, 5) is displayed on the display unit (2), said desired characteristic preferably being displayed in the same graph window (7, . . . , 10) as the effective particular transmission characteristic.

8. The method as claimed in claim 1, wherein the adjusted parameters are transmitted from the data processing apparatus (1) to the hearing-aid portions (4, 5).

9. A method to binaurally match transmission characteristics of both a hearing-aid portion (4) for a left ear and a hearing-aid portion (5) for a right ear, to a patient audiogram, said method using a data processing apparatus (1) connectable to a pointer device (3) and to a display unit (2), the pointer device (3) being used to change parameters of the transmission characteristics, wherein parameters of one of the hearing-aid portions (4, 5) can be adjusted independently of the parameters of the other hearing-aid portion (5, 4) and wherein the parameters of both hearing-aid portions (4, 5) can be adjusted simultaneously.

10. The method as claimed in claim 9, wherein, when mutually corresponding parameter values are adjusted, a differential of the corresponding parameter values remains constant.

11. The method as claimed in either of claims 9 and 10, wherein the parameters are adjustable by means of scroll bars (11 . . . 16) shown on the display unit (2), said scroll bars consisting of at least one scroll box (18, BL, BR) movable between switching surfaces (19, 20, G, K), an instantaneous distance between the scroll box (18, BL, BR) and the switching surfaces (19, 20, G, K) representing the differential between an instantaneous parameter value and a minimum or maximum value, a parameter of one hearing-aid portion (4, 5) being adjusted between the scroll box (18, BL, BR) and one of the switching surfaces (19, 20, G, K), by one of: dragging the corresponding scroll box (18, BL, BR) using the pointer device (3) and clicking.

12. The method as claimed in claim 11, wherein the scroll box (18) is split into two parts (BL, BR) of which one part (BL) is used to adjust a parameter of one of the hearing-aid portions (4, 5) and the other part (BR) is used to adjust the corresponding parameter of the other hearing-aid portion (5, 4), and in that simultaneous adjustment of the parameters of the two hearing-aid portions (4, 5) is implemented by means of the switching surfaces (G, K).

13. The method as claimed in claim 11, wherein one of the instantaneous absolute value or the instantaneous relative value computed in relation to a reference value of a scroll bar (11, . . . , 16) is numerically displayed in the region of the scroll bar (11, . . . , 16).

14. The method as claimed in claim 9, wherein particular effective transmission characteristics of the hearing-aid portions (4, 5) are graphically displayed in graph windows (7, . . . , 10).

15. The method as claimed in claim 14, wherein a desired transmission characteristic for at least one of the hearing-aid portions (4, 5) is displayed on the display unit (2), said desired characteristic preferably being displayed in the same graph window (7, . . . , 10) as the effective particular transmission characteristic.

16. The method as claimed in claim 9, wherein the adjusted parameters are transmitted from the data processing apparatus (1) to the hearing-aid portions (4, 5).

* * * * *